US008875686B2

(12) United States Patent
Iwata

(10) Patent No.: US 8,875,686 B2
(45) Date of Patent: Nov. 4, 2014

(54) INTERNAL COMBUSTION ENGINE

(75) Inventor: Yasushi Iwata, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 532 days.

(21) Appl. No.: 12/808,246

(22) PCT Filed: Dec. 23, 2008

(86) PCT No.: PCT/IB2008/003608

§ 371 (c)(1),
(2), (4) Date: Jun. 15, 2010

(87) PCT Pub. No.: WO2009/087458

PCT Pub. Date: Jul. 16, 2009

(65) Prior Publication Data

US 2010/0269803 A1 Oct. 28, 2010

(30) Foreign Application Priority Data

Dec. 27, 2007 (JP) ..... 2007-337673

(51) Int. Cl.
*F02B 25/06* (2006.01)
*F01M 13/02* (2006.01)
*F01M 13/04* (2006.01)

(52) U.S. Cl.
CPC ..... *F01M 13/023* (2013.01); *F01M 2013/045* (2013.01)
USPC ..... 123/572; 123/573; 123/574; 123/41.86

(58) Field of Classification Search
USPC ..... 123/572–574, 41.86
See application file for complete search history.

(56) References Cited

U.S. PATENT DOCUMENTS 2,359,485 A 10/1944 Lowther
4,501,234 A 2/1985 Toki et al.
4,502,424 A * 3/1985 Katoh et al. ..... 123/41.86

(Continued)

FOREIGN PATENT DOCUMENTS

JP 63-123714 U 8/1988
JP 10-274025 A 10/1998
JP 2005-171921 A 6/2005
JP 2006-336595 A 12/2006

OTHER PUBLICATIONS

German Office Action mailed Nov. 21, 2011 for counterpart German Application No. 11 2008 003 487.7-13.

*Primary Examiner* — Marguerite McMahon
*Assistant Examiner* — James Kim
(74) *Attorney, Agent, or Firm* — Sughrue Mion, PLLC

(57) ABSTRACT

In an internal combustion engine (10), oil in an oil pan (21) is pressure-fed to lubrication sites through operation of an oil pump (22). After being used for lubrication of the lubrication sites, the oil runs down and collects in the oil pan (21). The internal combustion engine (10) is provided with a blow-by gas process device (40) including a communication passageway (48) that connects a portion of the intake passageway (12) on the downstream side of the throttle valve (13) in the intake flow direction and an interior of the crankcase (15) in communication. A pressure chamber (47) to which an end portion of the communication passageway (48) is open is defined in the interior of the crankcase (15). Oil scattered in the interior of the crankcase (15) is introduced into an interior of the pressure chamber (47) before mixing with the oil collected in the oil pan (21).

13 Claims, 3 Drawing Sheets

(56) References Cited

U.S. PATENT DOCUMENTS

| | | | | |
|---|---|---|---|---|
| 4,541,399 | A | 9/1985 | Tanaka et al. | |
| 5,495,833 | A * | 3/1996 | Ishizaka et al. | 123/179.25 |
| 6,405,721 | B1 * | 6/2002 | Moren | 123/572 |
| 6,425,451 | B2 * | 7/2002 | Yoshida et al. | 180/219 |
| 6,854,454 | B2 * | 2/2005 | Obayashi et al. | 123/572 |
| 7,845,342 | B2 * | 12/2010 | Terada et al. | 123/572 |
| 2002/0046743 | A1 * | 4/2002 | Moren | 123/572 |
| 2004/0159313 | A1 * | 8/2004 | Obayashi et al. | 123/572 |
| 2004/0244783 | A1 * | 12/2004 | Ookawa et al. | 123/572 |
| 2005/0011503 | A1 * | 1/2005 | Deane et al. | 123/572 |

* cited by examiner

INTERNAL COMBUSTION ENGINE

BACKGROUND OF THE INVENTION

1. Field of the Invention

The invention relates to an internal combustion engine in which the oil that collects in an oil pan is supplied to lubrication sites through operation of an oil pump.

2. Description of the Related Art

Usually, an oil pan is mounted on a lower portion of an internal combustion engine in a vertical direction, and an oil for lubrication collects in the oil pan. Then, the oil is pressure-fed from the oil pan through operation of an oil pump so as to be supplied to lubrication sites of the internal combustion engine, such as the bearing portions of the crankshaft, and the like. Besides, a construction is provided in which the oil having used for lubrication of lubrication sites runs down from the lubrication sites to collect in the oil pan.

In such an internal combustion engine, gas (e.g., air, the blow-by gas, etc.) in its interiors (e.g., the interior of the crankcase) inevitably mixes into the oil. If such a gas having mixed into the oil forms bubbles in the oil, the bubbles become a factor that brings about a decline of the pressure-feeding or pumping performance of the oil pump and therefore a decline of the lubrication performance, etc.

Therefore, a device for removing bubbles from oil is proposed in Japanese Patent Application Publication No. 2005-171921 (JP-A-2005-171921). This device is equipped with a depressurization chamber which is defined within the oil pan and into which oil flows. Oil is sucked into the oil pump via the depressurization chamber. Besides, an oil inlet opening that is formed in the depressurization chamber functions as a so-called throttle. Then, in the foregoing device, the decline of pressure associated with the inflow of oil into the depressurization chamber promotes the separation of bubbles from the oil. Therefore, the oil from which bubbles have been separated is sucked into the oil pump.

In the foregoing device, during operation of the oil pump, that is, during operation of the internal combustion engine, the foregoing oil inlet opening functions as a throttle. Therefore, inconveniences, such as an increase of the operation load on the oil pump, and a thereby-caused increase of the fuel consumption of the internal combustion engine, etc., are likely to come about, in comparison with an internal combustion engine that is not equipped with the depressurization chamber. Thus, this device cannot be said to efficiently separate bubbles from oil. In this respect, there is a room for betterment.

SUMMARY OF THE INVENTION

The invention provides an internal combustion engine capable of suitably separating, from oil, bubbles of gas that has mixed in oil.

An aspect of the invention relates to an internal combustion engine having a structure such that oil in an oil pan is pressure-fed to a lubrication site through operation of an oil pump and such that the oil having been used for lubrication of the lubrication site runs down to and collect in the oil pan. The internal combustion engine includes: a blow-by gas process device having a discharge passageway that connects a portion of the intake passageway on a downstream side of the throttle valve in an intake flow direction and an interior of a crankcase in communication, and a one-way valve that permits gas to be discharged only in a direction from the interior of the crankcase to the intake passageway through the discharge passageway; a pressure chamber which is defined in the interior of the crankcase and to which an end portion of the discharge passageway is open; and forced introduction means for introducing oil scattered in the interior of the crankcase into an interior of the pressure chamber before the oil mixes with the oil collected in the oil pan.

According to the foregoing construction, in an internal combustion engine provided with a blow-by gas process device that discharges a blow-by gas in the crankcase to the intake passageway by utilizing the pressure (so-called intake negative pressure) in a portion of the intake passageway on the downstream side of the throttle valve in the intake flow direction, the utilization of the intake negative pressure makes it possible to make the pressure in a portion within the crankcase (in the pressure chamber) lower than the ambient pressure. Then, by passing oil through the pressure chamber whose pressure has been lowered, the pressure of the oil can be reduced. Thus, according to the foregoing construction, bubbles having mixed in oil can be efficiently separated the oil by utilizing the intake negative pressure, without increasing the load on the oil pump.

In the internal combustion engine in accordance with this aspect, the pressure chamber may have a window portion that connects the interior of the pressure chamber and the interior of the crankcase other than the pressure chamber in communication, and the forced introduction means may introduce the scattered oil into the interior of the pressure chamber through the window portion before the oil mixes with the oil collected in the oil pan.

In the internal combustion engine in accordance with this aspect, the window portion may be formed in a configuration such that at least a portion of the window portion overlaps with a projection portion in an inner wall surface of the crankcase that is defined by projecting an operation member operated together with the crankshaft within the crankcase to the inner wall surface of the crankcase from a direction orthogonal to a direction of an axis of the crankshaft, and the forced introduction means may be the operation member.

According to the foregoing constructions, the oil scattered in the crankcase can be forced to be introduced into the interior of the pressure chamber, by utilizing the airflow that is caused by the operation of an operation member.

In the internal combustion engine in accordance with the aspect of the invention, the internal combustion engine may be mounted in a vehicle in an inclined state in which one of two side walls of the crankcase in a direction orthogonal to the direction of the axis of the crankshaft is lower in position in the vehicle than another one of the side walls, and the pressure chamber may be formed on the side wall of the two side walls that is positioned lower in the vehicle than the other side wall.

According to this construction, the oil scattered in the crankcase can be guided by utilizing gravity when the oil is introduced into the pressure chamber.

In the internal combustion engine in accordance with the aspect of the invention, the blow-by gas process device may have an introduction passageway that connects a portion of the intake passageway on an upstream side of the throttle valve in the intake flow direction and the interior of the crankcase in communication, independently of the discharge passageway.

In the internal combustion engine in accordance with the aspect of the invention, pressure in the interior of the pressure chamber may be lower than pressure in the interior of the crankcase other than the pressure chamber.

In the internal combustion engine in accordance with the aspect of the invention, the end portion of the discharge passageway may be an end portion of the discharge passageway that is at a side of the crankcase.

In the internal combustion engine in accordance with the aspect of the invention, at least a portion of the window portion may be above a liquid surface of the oil collected in an interior of the oil pan, in a vertical direction.

In the internal combustion engine in accordance with the aspect of the invention, the window portion may be provided below the axis of the crankshaft in a vertical direction, and the crankshaft may rotate so that a lower surface of the crankshaft approaches the window portion.

In the internal combustion engine in accordance with the aspect of the invention, the direction orthogonal to the direction of the axis of the crankshaft may be orthogonal to the vertical direction.

In the internal combustion engine in accordance with the aspect of the invention, the oil pump may be driven by rotation of the crankshaft.

In the internal combustion engine in accordance with the aspect of the invention, the forced introduction means may introduce, in a forced manner, the scattered oil into the interior of the pressure chamber through the window portion before the oil mixes with the oil collected in the oil pan.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Hereinafter, an internal combustion engine in accordance with an embodiment of the invention will be described. Firstly, a general construction of an internal combustion engine in accordance with the embodiment will be described with reference to FIG. 1. Incidentally, the internal combustion engine in accordance with the embodiment is mounted as a drive source in a vehicle.

Figure 1:
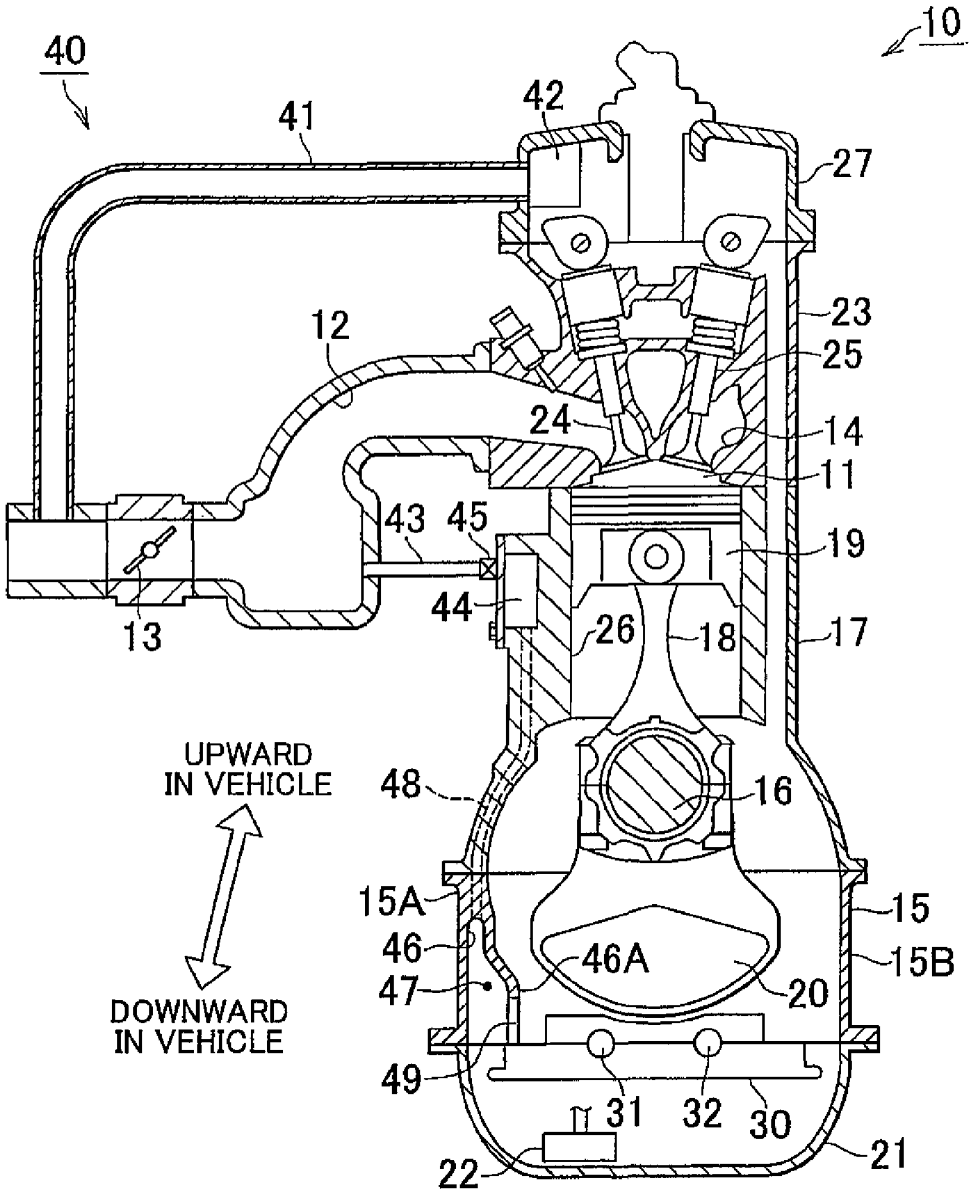
FIG. 1 is a schematic construction diagram of an internal combustion engine in accordance with an embodiment of the invention.

As shown in FIG. 1, an intake passageway 12 is connected to a combustion chamber 11 of an internal combustion engine 10. The intake passageway 12 is provided with a throttle valve 13. In this internal combustion engine 10, air is taken into the combustion chamber 11 through the intake passageway 12, and the amount of air taken in is adjusted through a control of the degree of opening of the throttle valve 13. Besides, an exhaust passageway 14 is connected to the combustion chamber 11 of the internal combustion engine 10.

Figure 3:
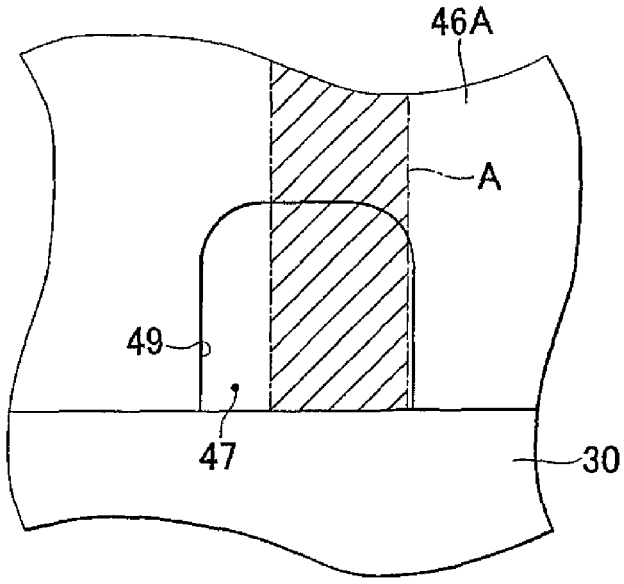
FIG. 3 is an enlarged side view showing a portion provided with a pressure chamber which is in an inner wall surface of a crankcase in accordance with an embodiment of the invention.

A crankshaft 16 is provided within a crankcase 15 of the internal combustion engine 10. The crankshaft 16, supported rotatably about its axis, is mounted on a lower portion of a cylinder block 17 of the internal combustion engine 10. A piston 19 is linked to the crankshaft 16 via a connecting rod 18. During operation of the internal combustion engine 10, reciprocating movements of the piston 19 in the up-down direction in FIG. 3 are converted into rotating movement of the crankshaft 16 by the connecting rod 18. Furthermore, the crankshaft 16 is provided with a counter weight 20 for restraining the occurrence of vibrations associated with rotational of the engine.

The internal combustion engine 10 is provided with an oil pan that has such a configuration as to cover a vehicle's-lower-side end portion of the engine 10. Besides, an oil pump 22 that pressure-feeds oil from the oil pan 21 is mounted on the internal combustion engine 10. The oil pump 22 employed in this embodiment is a mechanically driven-type pump that is driven by the turning force of the crankshaft 16 of the internal combustion engine 10. The oil pumped up by the oil pump 22 is pressure-fed to various lubrication sites of the internal combustion engine 10. Incidentally, examples of the various lubrication sites include sliding portions of and around the crankshaft 16, the connecting rod 18 and the piston 19 that are disposed within the cylinder block 17, portions of and around an intake valve 24, an exhaust valve 25, an intake camshaft, and an exhaust camshaft (none of which is shown) that are disposed within the cylinder head 23, etc. Then, the oil that has been used to lubricate the various lubrication sites of the internal combustion engine 10 runs down along the interior of the internal combustion engine 10 (more specifically, the cylinder head 23, the cylinder block 17, and the crankcase 15), and then is collected again in the oil pan 21.

Besides, a balancer mechanism 30 is mounted on the internal combustion engine 10, at a position within the crankcase 15 at which the crankshaft 16 and the oil pan 21 are separated from each other. The balancer mechanism 30 operates so as to cancel out the inertia force of the piston 19 that acts in the moving direction of the piston 19 during operation of the internal combustion engine 10.

Concretely, the balancer mechanism 30 has, at a side lower than the crankshaft 16 relative to the vehicle, two balance shafts 31, 32 that are rotatably supported so as to be parallel to the crankshaft 16. Each of the balance shafts 31, 32 is provided with a weight (not shown) in such a state that its center of gravity does not coincide with the axis of a corresponding one of the balance shafts 31, 32. The balance shafts 31, 32 are linked to the crankshaft 16 via a gear mechanism (not shown).

In the balancer mechanism 30, as the crankshaft 16 rotates, the balance shafts 31, 32, together with their weights, rotate synchronously with the crankshaft 16. Therefore, the center of gravity of each weight changes so that the inertial force of the weight moves in the movement directions of the piston 19, and thus cancels out the inertial force of the piston 19.

Furthermore, the internal combustion engine 10 is provided with a blow-by gas process device 40. The blow-by gas process device 40 is a device for processing the combustion gas that has leaked from the combustion chamber 11 into the crankcase 15 through the clearance between the sliding surfaces of the cylinder 26 and the piston 19, that is, the blow-by gas, by returning the gas into the intake air.

The blow-by gas process device 40 is equipped with an introduction passageway 41 that connects a portion of the intake passageway 12 on an upstream side of the throttle valve 13 in the intake flow direction and an interior of the internal combustion engine 10 (specifically, an interior of a cylinder head cover 27 of the engine 10) to each other in communication. An oil separator 42 for separating the blow-by gas and oil mist is disposed within the cylinder head cover 27. Via the oil separator 42, the introduction passageway 41 is connected in communication with the cylinder head cover 27.

Besides, the blow-by gas process device 40 is also equipped with a breather passageway 43 that connects a portion of the intake passageway 12 on the downstream side of the throttle valve 13 in the intake flow direction (hereinafter, simply referred to as "downstream side) and an interior of the crankcase 15 with each other in communication. Incidentally, an oil separator 44 for separating the blow-by gas and oil mist is disposed in the crankcase 15. Via the oil separator 44, the breather passageway 43 is connected in communication with the crankcase 15. Each of the introduction passageway 41 and the breather passageway 43, independently of each other, connects the intake passageway 12 and the interior of the crankcase 15 in communication.

In the blow-by gas process device 40, the blow-by gas within the crankcase 15 is sucked into the intake passageway 12 through the breather passageway 43 and therefore returned into the intake air due to the difference between the internal pressure in the crankcase 15 that has become close to the atmospheric pressure due to the introduction of external air through the introduction passageway 41, and the pressure (intake negative pressure) in the portion of the intake passageway 12 on the downstream side of the throttle valve 13.

Incidentally, in the blow-by gas process device 40, one of two end portions of the breather passageway 43 is connected to the crankcase 15 (specifically, to the oil separator 44) via a PCV valve 45, and the other end portion thereof is connected to the intake passageway 12. The PCV valve 45 is a differential pressure-actuated valve. The degree of opening of the PCV valve 45 is altered to the greater degree the higher the pressure on the crankcase 15 side is than the pressure on the intake passageway 12 side. When the pressure on the crankcase 15 side is lower than or equal to the pressure on the intake passageway 12 side, the PCV valve 45 is closed. Due to this PCV valve 45, the introduction of external air from the intake passageway 12 into the crankcase 15 through the breather passageway 43 is prohibited, and the discharge of the blow-by gas from inside the crankcase 15 to the intake passageway 12 is permitted. Besides, due to the PCV valve 45, the amount of flow of the blow-by gas discharged into the intake passageway 12 through the breather passageway 43 is autonomously adjusted according to the difference between the pressure on the crankcase 15 side and the pressure on the intake passageway 12 side.

In the internal combustion engine 10 in accordance with this embodiment, bubbles that have mixed into the oil are separated by lowering the pressure of the oil by utilizing the intake negative pressure are separated from the oil. Hereinafter, a construction for achieving the separation of bubbles from the oil will be described in detail.

Figure 2:
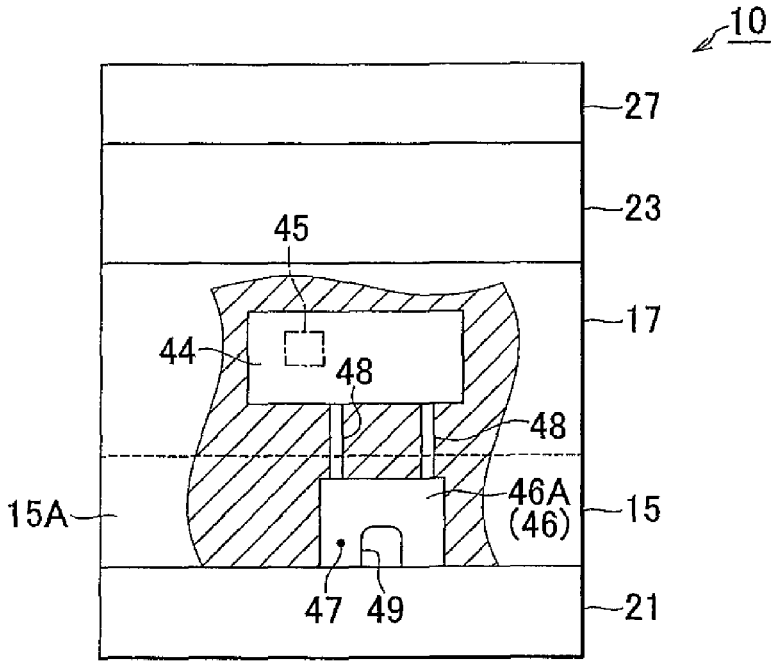
FIG. 2 is a partial sectional view showing a partial sectional structure of an internal combustion engine in accordance with an embodiment of the invention.

FIG. 2 shows a partial sectional structure of the internal combustion engine 10. As shown in FIGS. 1 and 2, an inside surface of the crankcase 15 of the internal combustion engine 10 has a recess portion 46 that is open at a vehicle's-lower-side portion thereof and that extends toward a vehicle upper side. Within the crankcase 15, the balancer mechanism 30 is disposed at such a position as to partially cover a vehicle's-lower-side portion of the recess portion 46. Thus, within the crankcase 15, a chamber (pressure chamber 47) defined by an inner wall surface of the recess portion 46 and an upper surface of the balancer mechanism 30 is provided.

Besides, the oil separator 44 is integrally provided on a side wall of the crankcase 15 of the internal combustion engine 10, and the PCV valve 45 is mounted on an outer surface of the side wall of the crankcase 15. Besides, a communication passageway 48 that connects the oil separator 44 and the pressure chamber 47 in communication is formed in the side wall of the crankcase 15. Incidentally, in this embodiment, the breather passageway 43 and the communication passageway 48 function as discharge passageways.

In the internal combustion engine 10, when the pressure on the intake passageway 12 side in the breather passageway 43 is lower than the pressure on the crankcase 15 side (concretely, the oil separator 44 side), that is, when the PCV valve 45 is open, intake negative pressure is introduced to the pressure chamber 47, so that the internal pressure in the pressure chamber 47 becomes lower than the ambient pressure within the crankcase 15. Then, as oil passes through the pressure chamber 47 with a lowered pressure, the pressure of the oil declines, whereby the bubbles that have mixed into the oil are separated from the oil. Thus, according to this embodiment, bubbles that have mixed into oil can be efficiently separated by utilizing the intake negative pressure, without increasing the load on the oil pump 22.

As shown in FIG. 1, the pressure chamber 47 is formed on one of two side walls 15A, 15B of the crankcase 15 in a direction orthogonal to the direction of the axis of the crankshaft 16 that is positioned on a forward side (left side in FIG. 1), in a rotating (moving) direction (direction indicated by a hollow arrow in FIG. 4) of a vehicle's-lower-side end portion of the crankshaft 16, that is, a side wall 15A.

FIG. 3 shows a structure of a portion of the inner wall surface of the crankcase 15 on which the pressure chamber 47 is provided, in a view from the crankshaft 16 side. Incidentally, in FIG. 3, a portion shown by diagonal lines (projection portion A) shows a portion of the inner wall surface of the crankcase 15 on which the operation loci of operation members that operate in the crankcase 15 (for example, the connecting rod 18 and the counter weight 20) are projected from a direction orthogonal to the direction of the axis of the crankshaft 16. In this embodiment, the foregoing operation members function as forced introduction means.

As shown in FIG. 3, at a position situated in the projection portion A of a crankshaft 16-side wall portion 46A of the recess portion 46, a window portion 49 is formed which has a shape that is formed by cutting away a portion of the wall portion 46A that extends from a vehicle's-lower-side end portion of the wall portion 46A toward a vehicle's—upper-side thereof.

Figure 4:
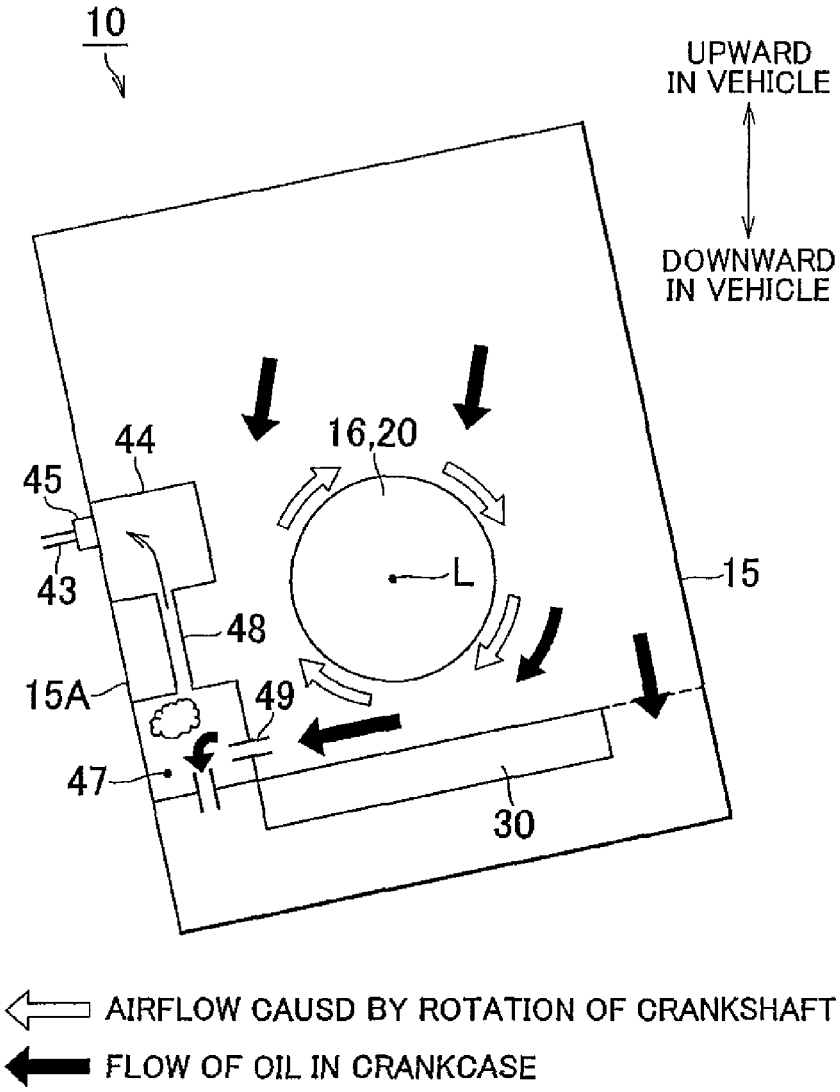
FIG. 4 is a schematic diagram schematically showing an internal structure of an internal combustion engine in accordance with an embodiment of the invention.

Thus, in the embodiment, the pressure chamber 47 is formed in such a shape as to have an opening in the projection portion A. FIG. 4 schematically shows an internal structure of the internal combustion engine 10 in accordance with this embodiment.

As shown by hollow arrows in FIG. 4, a flow of gas (that includes the blow-by gas) flowing around the axis L of the crankshaft 16 is formed within the crankcase 15 of the internal combustion engine 10 by rotation of the crankshaft 16 (that includes the counter weight 20). Besides, such a flow of gas (airflow) within the crankcase 15 blows a portion of the oil scattered in the crankcase 15 to the side wall 15A of the crankcase 15, as shown by solid arrows in FIG. 4. Incidentally, the momentum of the oil blown to the side wall 15A of the crankcase 15 is particularly strong in the projection portion A.

In the embodiment, since the pressure chamber 47 is formed in a configuration in which the pressure chamber 47 has an opening in the projection portion A of the side wall 15A. Besides, the internal combustion engine 10 has such a structure that a portion of the oil scattered in the crankcase 15 falls down to the upper surface of the balancer mechanism 30. Therefore, in this embodiment, a portion of the oil that has fallen to the upper surface of the balancer mechanism 30 is pushed by the foregoing airflow so as to be forced into the interior of the pressure chamber 47. Furthermore, in this embodiment, the window portion 49 is provided vertically downward of the axis of the crankshaft 16, and the crankshaft 16 rotates so that a lower surface thereof moves closer to the window portion 49. Therefore, the scattered oil can be efficiently introduced into the interior of the pressure chamber 47.

Besides, as is apparent from the vehicle up-down direction indicated in FIG. 4 (or FIG. 1), the internal combustion engine 10 is mounted in the vehicle so that during a stop of the vehicle on a horizontal road surface, the side wall to which the intake passageway 12 is connected is higher in the vehicle up-down direction than the side wall to which the exhaust passageway 14 (FIG. 1) is connected. In other words, the internal combustion engine 10 is mounted in the vehicle in an inclined state in which one of the two side walls 15A, 15B of the crankcase 15 in a direction orthogonal to the direction of the axis of the crankshaft 16 is lower in position in the vehicle than the other one of the side walls 15A, 15B. Besides, the pressure chamber 47 is formed on the side wall 15A that is the lower one of the two side walls 15A, 15B in position in the vehicle.

The oil scattered in the crankcase 15 falls under gravity. The internal combustion engine 10 is mounted in the vehicle in the inclined state as described above. Therefore, in the internal combustion engine 10, the oil scattered in the crankcase 15 is likely to fall onto or near the side wall 15A that is the lower one of the two side walls 15A, 15B with reference to the vehicle. Therefore, according to this embodiment, when the oil scattered in the crankcase 15 is introduced into the pressure chamber 47, the oil can be guided by utilizing gravity. Therefore, the oil can be efficiently guided to the pressure chamber 47, in comparison with a construction in which the pressure chamber 47 is formed on the other side wall 15B, that is, the side wall 15B that is the higher one of the two side walls in position in the vehicle.

Thus, since the internal combustion engine 10 in accordance with the embodiment has such a structure that the oil scattered in the crankcase 15 is introduced into the pressure chamber 47 in a forced manner, the amount of oil passing through the pressure chamber 47 is relatively large, and therefore bubbles are efficiently separated from the oil, in comparison with an internal combustion engine that does not adopt such a structure.

As described above, according to this embodiment, effects as stated below can be achieved. (1) The bubbles mixed in the oil can be efficiently separated by utilizing the intake negative pressure, without increasing the load on the oil pump 22. (2) In the crankcase 15, the pressure chamber 47 is formed in a configuration in which the pressure chamber 47 has an opening in the projection portion in the inner wall surface of the crankcase 15 that is defined by projecting the connecting rod 18 and the counter weight 20 operated together with the crankshaft 16 within the crankcase 15 to the inner wall surface of the crankcase 15 from a direction orthogonal to the direction of the axis of the crankshaft 16. Therefore, utilizing the airflows caused by the operation of the connecting rod 18 and the counter weight 20, the oil scattered in the crankcase 15 can be introduced into the interior of the pressure chamber 47 in a forced fashion. (3) The pressure chamber 47 is formed on the side wall 15A of the two side walls 15A, 15B of the crankcase 15 in a direction orthogonal to the direction of the axis of the crankshaft 16, the side wall 15A being the lower one in position in the vehicle. Therefore, when the oil scattered in the crankcase 15 is introduced into the pressure chamber 47, the oil can be guided by utilizing gravity.

Incidentally, the embodiment may be altered as follows. The construction of the blow-by gas process device can be appropriately altered as long as the crankcase 15-side end portion of the discharge passageway that connects the portion of the intake passageway 12 on the downstream side of the throttle valve 13 and the interior of the crankcase 15 with each other in communication has an opening within the pressure chamber 47.

The construction in accordance with the foregoing embodiment is not limited to the internal combustion engine 10 that is equipped with the mechanically driven-type oil pump 22, but is also applicable to internal combustion engine equipped with an electric type oil pump that is driven by an electric motor.

In conjunction with the two side wall of the crankcase in a direction orthogonal to the direction of the axis of the crankshaft, the pressure chamber may be formed on the side wall that is the higher one of the two side walls in position in the vehicle, provided that the higher side wall is the side wall positioned at a forward side in the rotating direction of the vehicle's-lower-side end portion of the crankshaft.

The pressure chamber 47 and/or the window portion 49 may also be formed in a configuration in which the opening is formed at a position slightly apart from the projection portion A. For example, the pressure chamber may also be formed in a portion other than the projection portion A as long as the internal combustion engine is equipped with a construction for forcing the oil scattered in the crankcase 15 into the pressure chamber, for example, a construction in which a jet opening through which oil jets out into the crankcase 15 is directed to the pressure chamber, or the like.

The foregoing embodiment is also applicable to internal combustion engines in which the balancer mechanism 30 is not provided. Among such internal combustion engines, an internal combustion engine provided with a baffle plate that has such a shape as to partition the crankshaft 16 and the oil pan 21, instead of the balancer mechanism 30 allows a portion of the oil falling down to the upper surface of the baffle plate to be pushed down by using the air flow and therefore be introduced into the interior of the internal combustion 47 in a forced fashion.

The invention is also applicable to internal combustion engines that are mounted in vehicles so that the two side walls of the crankcase in a direction orthogonal to the direction of axis of the crankshaft are at the same height, such as an internal combustion engine that is mounted in a vehicle in a state in which the cylinders of the internal combustion engine extend in an up-down direction of the vehicle.

While some embodiments of the invention have been illustrated above, it is to be understood that the invention is not limited to details of the illustrated embodiments, but may be embodied with various changes, modifications or improvements, which may occur to those skilled in the art, without departing from the spirit and scope of the invention.

The invention claimed is:

1. An internal combustion engine comprising:

an intake passageway having a throttle valve;

an oil pan from which oil is pressure-fed to a lubrication site through operation of an oil pump and in which the oil having been used for lubrication of the lubrication site runs down and collects;

a blow-by gas process device having a discharge passageway that connects a portion of the intake passageway on a downstream side of the throttle valve in an intake flow direction and an interior of a crankcase in communication, a one-way valve that permits gas to be discharged only in a direction from the interior of the crankcase to the intake passageway through the discharge passageway;

a pressure chamber disposed in the interior of the crankcase and to which an end portion of the discharge passageway is open; and a forced introduction device, which is connected to a crankshaft, that introduces oil scattered in the interior of the crankcase into an interior of the pressure chamber, before the oil mixes with the oil collected in the oil pan, wherein:

the pressure chamber has a window portion configured to connect the interior of the pressure chamber and the interior of the crankcase, other than the pressure chamber;

the forced introduction device introduces the scattered oil into the interior of the pressure chamber through the window portion;

at least a portion of the window portion overlaps with a projection portion in an inner side wall of the crankcase, wherein the projection portion is an area of the inner side wall onto which an operation loci of the forced introduction device projects when viewed from a direction orthogonal to a direction of an axis of the crankshaft;

the forced introduction device is at least one of a connecting rod and a counter weight;

the window portion is an opening, the opening being disposed below the axis of the crank shaft in a vertical direction and directly facing the forced introduction device; and the internal combustion engine includes no intermediate structure between the window portion and the forced introduction device, wherein movement of the forced introduction device directs gas from the interior of the crankcase directly through the window, so that the gas moves into the pressure chamber and then through the discharge passageway via an oil separator.

2. The internal combustion engine according to claim 1, wherein:

the internal combustion engine is mounted in a vehicle in an inclined state in which one of two side walls of the crankcase in a direction orthogonal to the direction of the axis of the crankshaft is lower in position in the vehicle than another one of the side walls; and the pressure chamber is formed on the side wall of the two side walls that is positioned lower in the vehicle than the other side wall.

3. The internal combustion engine according to claim 1, wherein the blow-by gas process device has an introduction passageway that connects a portion of the intake passageway on an upstream side of the throttle valve in the intake flow direction and the interior of the crankcase in communication, independently of the discharge passageway.

4. The internal combustion engine according to claim 1, wherein pressure in the interior of the pressure chamber is lower than pressure in the interior of the crankcase other than the pressure chamber.

5. The internal combustion engine according to claim 1, wherein the end portion of the discharge passageway is at a side of the crankcase.

6. The internal combustion engine according to claim 1, wherein the end portion of the discharge passageway is above the window portion in a vertical direction.

7. The internal combustion engine according to claim 1, wherein:

the crankshaft rotates so that a lower surface of the crankshaft approaches the window portion.

8. The internal combustion engine according to claim 1, wherein at least a portion of the window portion is above a liquid surface of the oil collected in an interior of the oil pan, in a vertical direction.

9. The internal combustion engine according to claim 1, wherein the oil pump is driven by rotation of the crankshaft.

10. The internal combustion engine according to claim 1, wherein the forced introduction device introduces, in a forced manner, the scattered oil into the interior of the pressure chamber through the window portion.

11. The internal combustion engine according to claim 1, further comprising a balancer mechanism, and wherein the pressure chamber is defined by the inner side wall, a side wall of the crank case and an upper surface of the balancer mechanism.

12. The internal combustion engine according to claim 1, wherein at least a portion of the discharge passageway is formed in the crankcase, and wherein the inner side wall extends downwardly from the end portion of the discharge passageway so as to separate the pressure chamber from other portions of the interior of the crankcase and the window portion is formed at the lower end of the inner side wall.

13. The internal combustion engine according to claim 1, wherein the entire opening is disposed below the axis of the crank shaft.

* * * * *